United States Patent [19]

Roche

[11] Patent Number: 4,909,327

[45] Date of Patent: Mar. 20, 1990

[54] MARINE RISER

[75] Inventor: Joseph R. Roche, Kingwood, Tex.

[73] Assignee: Hydril Company, Houston, Tex.

[21] Appl. No.: 301,636

[22] Filed: Jan. 25, 1989

[51] Int. Cl.[4] ..... E21B 7/12

[52] U.S. Cl. ..... 166/359; 166/367; 175/7; 405/211

[58] Field of Search ..... 166/350, 359, 367; 175/6, 7; 405/211

[56] References Cited

U.S. PATENT DOCUMENTS

| | | | |
|---|---|---|---|
| 3,248,886 | 5/1966 | Blenkarn | 405/211 |
| 3,352,118 | 11/1967 | Burkhardt | 405/211 |
| 3,858,401 | 1/1975 | Watkins | 405/195 |
| 3,952,526 | 4/1976 | Watkins et al. | 405/195 |
| 3,957,112 | 5/1976 | Knibble et al. | 166/359 |
| 3,992,889 | 11/1976 | Watkins et al. | 405/195 |

*Primary Examiner*—William P. Neuder

*Attorney, Agent, or Firm*—Vaden, Eickenroht, Thompson & Boulware

[57] ABSTRACT

There are disclosed several embodiments of a marine riser having means for disrupting smooth flow of seawater along its length of the riser and thus damping vertical oscillation of the riser when its lower end is released from a subsea wellhead.

16 Claims, 2 Drawing Sheets

MARINE RISER

This invention relates generally to apparatus for use in drilling or producing an offshore well. More particularly, it relates to improvements in a marine riser which is suspended from a vessel and releasably connected at its lower end to a subsea wellhead on or near the ocean floor.

As well known in the art, a marine riser is an elongate conductor made up of pipe joints connected end-to-end and, in the drilling of the well, extending between a drilling vessel and a blowout preventer stack on the wellhead. In use, the drilling riser guides drilling tools into and out of the well bore and returns drilling fluid circulating downwardly through the drill string back to the vessel.

As also known in the art, marine risers are useful in the production of a subsea wellhead, in which case they extend between a production vessel and the upper end of the wellhead. This invention contemplates that the riser to be described and claimed may be used either for drilling or production purposes.

The lower end of the riser is free of the subsea wellhead when it is being deployed or retrieved or when it must be released from the wellhead in order to abandon the well site due to well control problems, or when inclement weather necessitates suspension of activities to avoid excessive induced loads on the riser and its structural support on the vessel. Furthermore, it may be necessary to release the lower end of the riser if the vessel is unintentionally driven or drifts off location.

It is desirable that the period of vertical oscillation of the freely suspended riser be substantially different from that of the vessel. However, it has been determined that, in deep water, the riser may exhibit a resonant frequency of vertical oscillation approaching the natural frequency of the motion of the vessel.

When the well is drilled in deep water -- e.g., 2,000 feet or more below the water surface -- modules of buoyant material are often disposed about the riser so as to reduce tensile loads in the riser pipe joints and couplings and to reduce the top tensioner capacity and the hook load.

The disposal of buoyant material about the riser alters its weight relative to its mass, thus changing its frequency of vertical oscillation and its free-fall acceleration. Thus, the vessel may heave downwardly faster than the riser, thus putting the upper end of the riser into compression. These circumstances may severely damage the riser couplings and pipe joints as well as its structural support on the vessel.

In an effort to reduce the risk of damage to the riser and/or vessel, it has been proposed to damp the motion of the riser. Thus, as disclosed, for example, in U.S. Pat. Nos. 3,858,401, 3,952,526 and 3,992,889, a means is provided for ballasting the lower joints of the riser by jettisoning air from buoyancy cans carried by the joints. Displacement of the air by the seawater adds mass to the riser and thus alters its frequency of oscillation.

However, a riser of this construction has several drawbacks including the delayed response during ballasting. Also, of course, it requires considerable expense including the capital cost of air compressors as well as the time and effort involved in running, maintaining and providing space for the compressor. Still further, the systems and equipment required to control the supply and exhaust of air to and from the cans are not only expensive, but also sources of malfunction and thus breakdown of the whole operation.

The primary object of this invention is to provide a marine riser whose oscillation is damped, when released from the wellhead, by means which is passive and requires no expensive and complex equipment as in the case of the prior riser above described. Another object of this invention is to provide such a riser which is of simple construction, and which, in one of its forms, is particularly well suited for use with a riser on which a body of buoyant material is carried.

These and other objects are accomplished, in accordance with the illustrated embodiments of the invention, by a riser and at least certain of the interconnected pipe joints making up the riser having means thereabout for disrupting flow along its length and thereby damping the vertical oscillation of the riser when released from the subsea wellhead. The means for so damping oscillation of the riser may take one of several alternative forms. For example, it may include means forming a restricted annular passageway along its length, baffles extending outwardly from it, convoluted passageways for the flow of seawater along its length or means forming a more restricted passageway to flow in one direction than the other.

Also, the damping means may be formed in a body of buoyant material carried about the riser, or, alternatively, in a body disposed about and integral with the riser. Thus, for example, such a body may be carried in spaced relation about the riser to form a restricted annular passageway between them. Alternatively, the body may closely surround the riser with the aforementioned baffles extending therefrom or the aforementioned passageways formed therein. Alternatively, the body may have valve means formed therein to produce the aforementioned differential in flow characteristics.

In the drawings, wherein like reference characters are used throughout to indicate like parts:

Figure 5A:
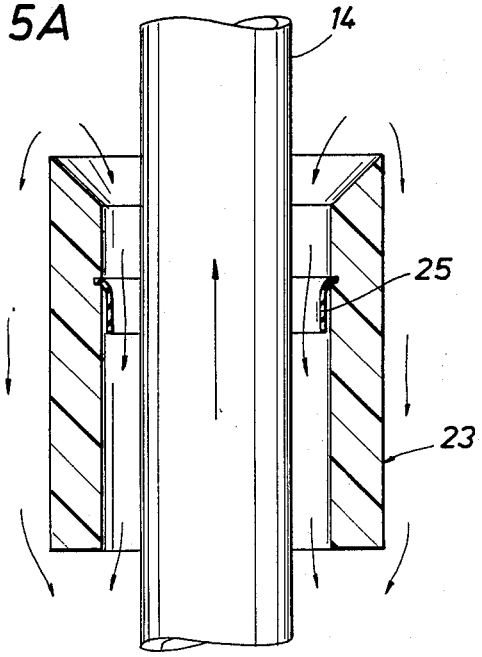
Figure 5B:
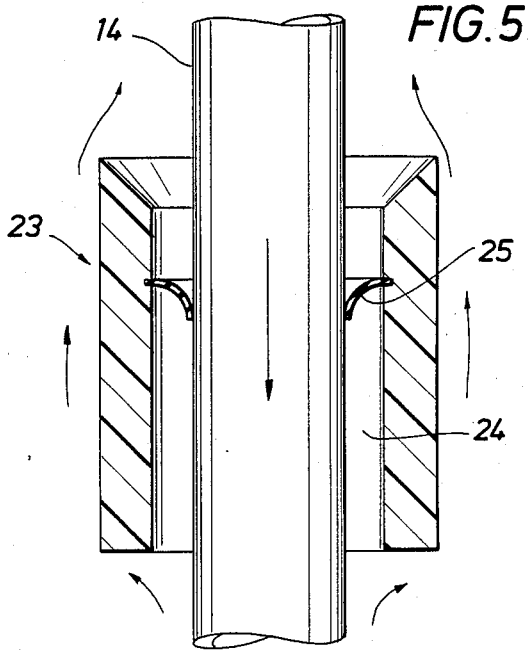
Figure 6:
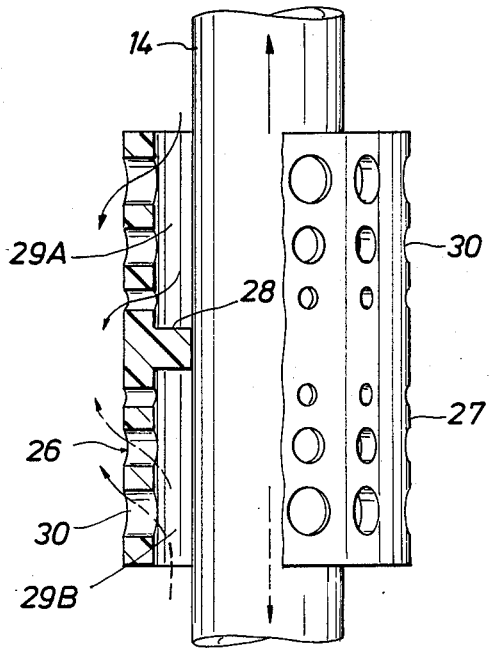

FIGS. 5A and 5B are views, partly in elevation and partly in section, of another alternative embodiment of the invention, wherein a tubular body of buoyant material is carried about the riser joint in spaced relation thereto to form an annular passageway between them and one way valve means is carried by the tubular body for controlling flow through the passageway, the valve means being shown in open position as the riser is moving upwardly in FIG. 5A and being shown in closed position as the riser is stationary or moving downwardly as shown in FIG. 5B; and FIG. 6 is a view, partly in elevation and partly in section, of a still further alternative embodiment of the invention, wherein the riser joint is surrounded by a body which is integral therewith and which has ports formed therein to cause the seawater to follow a convoluted path as the riser is moved upwardly and downwardly.

Figure 1:
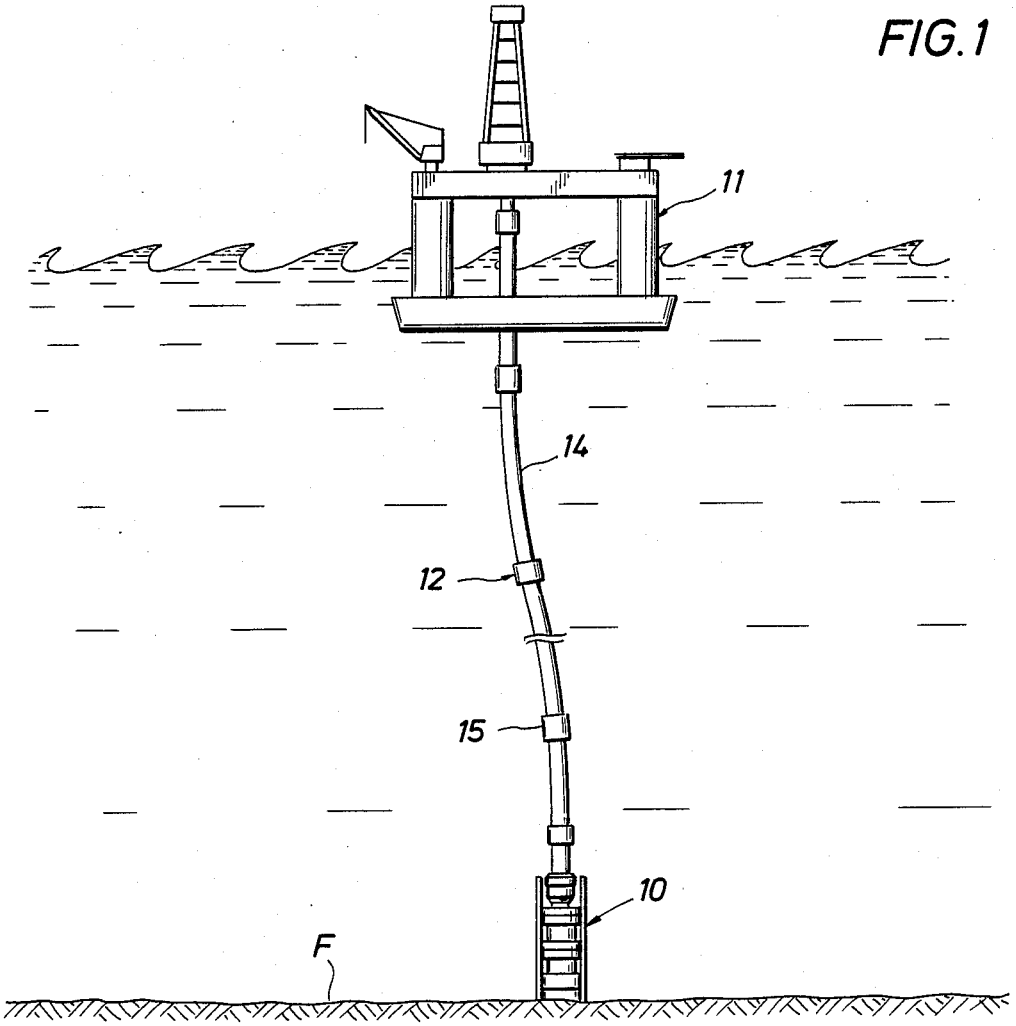
FIG. 1 is a diagrammatic illustration of apparatus for drilling an offshore well which includes a subsea wellhead, a drilling vessel at the water surface generally above the wellhead, and a riser pipe suspended from the drilling vessel and extending downwardly for releasable connection to the wellhead.

With reference now to the details of the above described drawings, FIG. 1 shows a subsea wellhead, indicated in its entirety by reference character 10, mounted in an upright position on the ocean floor F. As well known in the art, the wellhead includes a blowout preventer stack through which various drilling tools may be raised and lowered from and into the well bore by means of a rotary drill string. The drill string is raised and lowered and rotated by suitable equipment mounted on a drilling vessel 11 at the water surface generally above the wellhead. As shown, the drilling vessel is of the semi-submersible type, although it may be of any other floating type.

As also shown in FIG. 1, a riser pipe 12 is suspended at its upper end from the drilling vessel 11 and extends generally vertically to releasable connection at its lower end to the wellhead 10. Generally, the releasable connection is to the upper end of the blowout preventer stack, which in turn is at the upper end of the wellhead. As previously mentioned, the riser pipe provides a conductor which guides the drilling tools and drill string to and from the well, and further provides an annular passageway though which drilling fluid circulated downwardly through the drill string may be returned upwardly to the drilling vessel. Thus, as also well known in the art, suitable means are provided on the drilling vessel for circulating the drilling mud to and from the wellhead during the drilling operation.

As also shown diagrammatically in FIG. 1, the riser comprises an elongate conductor made up of joints 14 of pipe connected at their opposite ends by means of couplings 15. The suspension of the upper end of the riser pipe, and the releasable connection of its lower end, are merely shown diagrammatically since these are details well known in the art and forming no part of the present invention.

Figure 2:
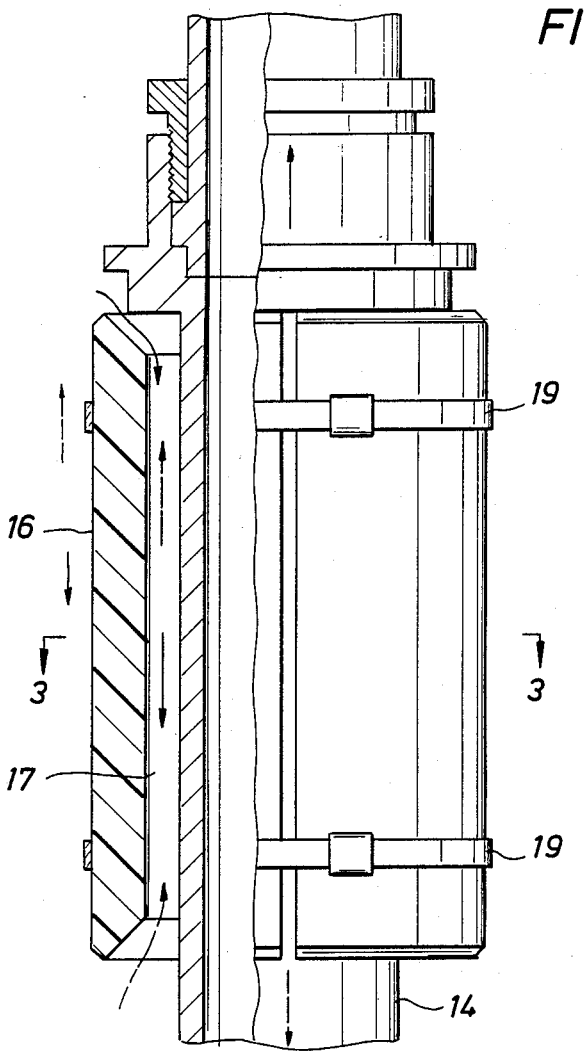
FIG. 2 is a view, partly in elevation and partly in section, of the upper end of a riser pipe joint constructed in accordance with one embodiment of the present invention wherein a body of buoyant material is carried about the riser joint in spaced relation thereto so as to form a restricted annular passageway between them.
Figure 3:
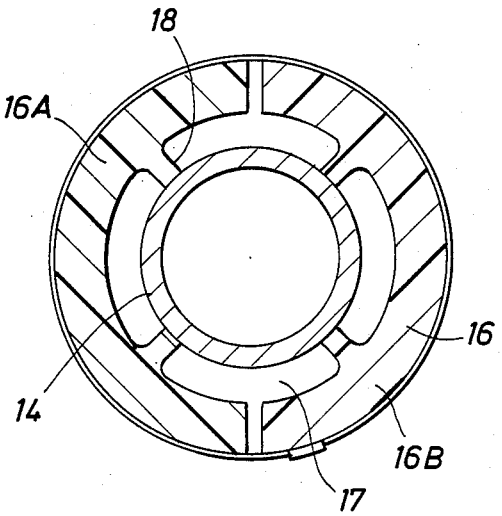
FIG. 3 is a cross-sectional view of the joint of FIG. 1, as seen along broken lines 3—3 of FIG. 2.

In the embodiment of the invention shown in FIGS. 2 and 3, a tubular body 16 of buoyant material is carried about the riser joint 14 in spaced relation thereto to form a restricted annular passageway 17 between them. More particularly, the body 16 is made up of substantially semicircular sections 16A and 16B, each having ribs 18 on their inner sides which bear against the outer diameter of the riser joint to space the inner sides of the body 16 therefrom.

The sections of the body 16 are held about the riser pipe by means of straps 19 buckled about them. The upper end of the riser joint is connected by a coupling to the next upper joint, and the body 16 is carried about the riser just below the coupling.

As indicated by solid arrows, upward movement of the riser, during its vertical oscillation, causes seawater to flow downwardly through the restricted annular passageway 17, while downward movement of the riser causes seawater to move upwardly through the restricted passageway. In either event, the annular passageway disrupts otherwise smooth flow along the length of the riser joint, and thus generally along the length of the riser, so as to damp the amplitude of vertical oscillation of the riser.

Body 16 may be formed of any suitable buoyant material such as that now used with prior art marine risers. For example, it may comprise a syntactic foam material marketed by Emerson and Cuming (Grace Syntactics) and known in the trade as "ECCOFLOAT".

Figure 4:
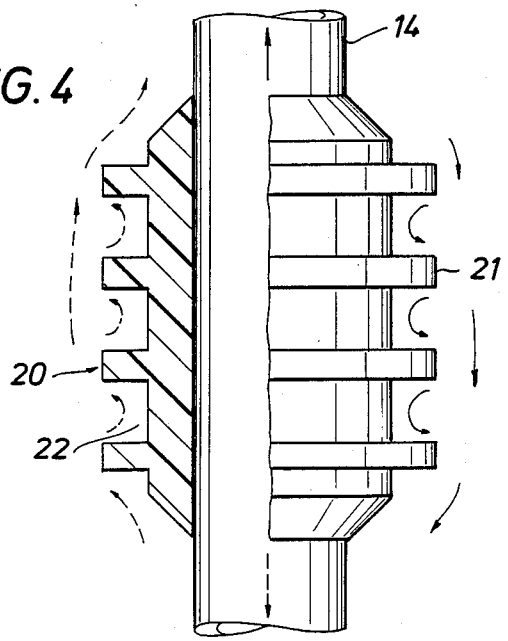
FIG. 4 is a view, also partly in elevation and partly in section, of a riser pipe joint constructed in accordance with an alternative embodiment of the invention, wherein a tubular body of buoyant material which closely surrounds the riser joint has baffles extending outwardly therefrom.

In the alternative embodiment illustrated in FIG. 4, a body 20 of buoyant material is carried by the riser joint 14 in closely surrounding relation thereto. Although not shown,it will be understood that suitable means may be provided for so mounting the body on the riser joint. In any event, baffles 21 extend outwardly from the inner tubular section 22 of the tubular body 20. Preferably, there is a plurality of such baffles, which may be spaced equally from one another, and which are of equal radial extent. Obviously, other arrangements of baffles may be provided.

As shown by the solid and broken lines of FIG. 4, the flow of seawater along the length of the riser pipe is disrupted during raising as well as lowering of the riser. In each case, the baffles cause eddy currents to be formed on the downstream side of each, and thus between adjacent baffles. As in the case of the embodiment of the invention illustrated in FIGS. 2 and 3, the smooth flow of seawater is thus disrupted to damp vertical oscillations of the riser.

In the embodiment of the invention shown in FIGS. 5A and 5B, a tubular body 23 much like that of the tubular body 16 of the embodiment of FIGS. 1 and 2 is carried about the riser joint 14 in spaced relation thereto to form an annular passageway 24 between them. Although not shown, it will be understood that ribs may also be formed on the inner sides of the tubular body 23 to hold it in spaced relation about the riser joint, and other means may be provided for carrying the body from the riser joint.

In any event, in this embodiment of the invention, the body has suitable means therein for causing seawater to flow through the passageway 24 at a faster rate as the riser pipe is moved in one direction than in the other. More particularly, the body is provided with one-way valve means which, as illustrated by the the solid and broken arrows of FIGS. 5A and 5B, permits flow through the passageway 24 when the riser is moved in one direction and prevents flow therethrough when the riser is moved in the other direction, thus disrupting flow along the length of the riser and thereby damping its vertical oscillation.

As illustrated, the valve comprises a flexible annular lip 25 having its outer end received in a groove about the inner diameter of the body 23 and being of a larger radial extend than the passageway 24 so as to cause it to flex downwardly so as to provide a lip type seal about the riser pipe when the riser is stationary, or as the riser pipe moves downwardly, as illustrated by the solid arrow of FIG. 5B. When, however, the riser is raised, subsea seawater flowing along the length of the riser joint will flex the lip 25 inwardly to permit flow therepast, as shown by the broken lines of FIG. 5A. In any case, however, the smooth flow is disrupted not only by the formation of the annular passageway between the riser pipe and the tubular body, but also by the restriction of flow in at least one direction within the passageway.

In the embodiment of the invention shown in FIG. 6, a body 26 is formed integrally with the riser joint 14 and includes a tubular section 27 which is spaced from the riser joint, and an annular rib 28 on the inner side of the section 27 which closely surrounds the riser joint generally intermediate the upper and lower ends of the section 27. Thus, the body forms upper and lower annular passageways 29A and 29B between the riser joint and body section 27 respectively above and below the annular rib 28.

Ports 30 are formed in the tubular section both above and below the annular rib 28 so as to connect the annular passageways 29A and 29B with the outside of the tubular section 27 and thus cause seawater to follow convoluted paths during oscillation of the riser which disrupts the flow and thus damps the vertical oscillation of the riser.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. In a marine riser adapted to be suspended from a vessel and releasable connected at its lower end to a subsea terminal, the improvement comprising a body thereabout having passageway means therethrough opening to each end of the body for disrupting smooth flow along the length of the riser and thereby damping the vertical oscillation of the riser when released from the subsea terminal.

2. A riser of the character described in claim 1, wherein the passageway means comprises a restricted annular passageway which extends through the length of the body.

3. A riser of the character described in claim 1, wherein the passageway means includes means causing flow therethrough to follow a convoluted path.

4. In a marine riser of the character defined in claim 1, wherein the body is of bouyant material carried about the riser.

5. In a marine riser of the character defined in claim 1, wherein the body is formed integrally with and about the riser.

6. In a tubular joint for use in a marine riser adapted to be suspended from a vessel for releasable connection at its lower end to a subsea terminal, the improvement comprising, a body about the joint having passageway means therethrough opening to each end of the body for disrupting smooth flow along the length of the riser and thereby damping the vertical oscillation of the riser when released from the subsea terminal.

7. A tubular joint of the character defined in claim 6, wherein the passageway means comprises a restricted annular passageway which extends through the length of the body.

8. A tubular joint of the character defined in claim 6, wherein the passageway means includes means causing flow therethrough to follow a convoluted path.

9. In a tubular joint for use in a marine riser adapted to be suspended from a vessel for releasable connection at its lower end to a subsea terminal, the improvement comprising, a body of bouyant material carried about the joint having passageway means therethrough opening to each end of the body for disrupting smooth flow along the length of the riser and thereby damping the vertical oscillation of the riser when released from the subsea terminal.

10. In a tubular joint for use in a marine riser adapted to be suspended from a vessel for releasable connection at its lower end to a subsea terminal, the improvement comprising, a body formed integrally with and about the joint having passageway means therethrough opening to each end of the body for disrupting smooth flow along the length of the riser and thereby damping the vertical oscillation of the riser when released from the subsea terminal.

11. In apparatus for use in drilling an offshore well wherein a marine riser suspended from a vessel is releasably connected at its lower end to a subsea terminal, the improvement comprising a body about the riser having passageway means therethrough opening to each end of the riser for disrupting smooth flow along the length of the riser and thereby damping its vertical oscillation when released from the subsea terminal.

12. In apparatus for use in producing an offshore well wherein a marine riser suspended from a vessel is releasably connected at its lower end to a subsea terminal, the improvement comprising a body about the riser having passageway means therethrough opening to each end of the riser for disrupting smooth flow along the length of the riser and thereby damping its vertical oscillation when released from the subsea terminal.

13. In a marine riser adapted to be suspended from a vessel and releasably connected at its lower end to a subsea terminal, the improvement comprising baffles extending outwardly from the riser for disrupting smooth flow along its length and thereby damping the vertical oscillation of the riser when released from the subsea terminal.

14. In a maring riser adapted to be suspended from a vessel and releasably connected at its lower end to a subsea terminal, the improvement comprising means forming a more restricted passageway to flow in one longitudinal direction along its length than the other and thereby damping the vertical oscillation of the riser when released from the subsea terminal.

15. In a tubular joint for use in a marine riser adapted to be suspended from a vessel for releasable connection at its lower end to a subsea terminal, the improvement comprising baffles extending outwardly from the joint for disrupting smooth flow along its length and thereby damping the vertical oscillation of the riser when released from the subsea terminal.

16. In a tubular joint for use in a marine riser adapted to be suspended from a vessel for releasable connection at its lower end to a subsea terminal, the improvement comprising one way valve means to allow fluid passage along the length of the joint when the joint moves in one vertical direction and to block fluid when the joint moves in the opposite direction, to thereby damp the vertical oscillation of the riser when released from the subsea terminal.

* * * * *